US006311758B1

(12) United States Patent
Sakabe et al.

(10) Patent No.: US 6,311,758 B1
(45) Date of Patent: Nov. 6, 2001

(54) SUCTION CASTING METHOD AND SUCTION CASTING APPARATUS

(75) Inventors: Haruyuki Sakabe; Tomokazu Sawada, both of Aichi-ken; Ryuuichi Masuda; Hiroyuki Urusidani, both of Okazaki, all of (JP)

(73) Assignees: Central Motor Wheel Co., Ltd., Anjo; Toyota Jidosha Kabushiki Kaisha, Toyota, both of (JP)

( * ) Notice: Subject to any disclaimer, the term of this patent is extended or adjusted under 35 U.S.C. 154(b) by 0 days.

(21) Appl. No.: 09/336,692

(22) Filed: Jun. 21, 1999

(30) Foreign Application Priority Data

Jun. 22, 1998 (JP) ..... 10-174281

(51) Int. Cl.[7] ..... B22D 18/06
(52) U.S. Cl. ..... 164/63; 164/255
(58) Field of Search ..... 164/63, 255

(56) References Cited

U.S. PATENT DOCUMENTS

| | | | | |
|---|---|---|---|---|
| 4,727,922 | * | 3/1988 | Nakano | 164/61 |
| 4,791,977 | | 12/1988 | Chandley | 164/63 |
| 5,042,561 | | 8/1991 | Chandley | 164/63 |
| 5,062,466 | * | 11/1991 | Kubisch et al. | 164/7.1 |

FOREIGN PATENT DOCUMENTS

| | | |
|---|---|---|
| 3-7465 | 2/1991 | (JP) . |
| 5-228603 | 9/1993 | (JP) . |
| 6-262334 | 9/1994 | (JP) . |
| 8-300136 | 11/1996 | (JP) . |
| 9-314309 | 12/1997 | (JP) . |

OTHER PUBLICATIONS

Patents Abstract of Japan, vol. 008, No. 040 (M–278), Feb. 21, 1984, JP 58196161, Nov. 15, 1983.

* cited by examiner

*Primary Examiner*—Nam Nguyen
*Assistant Examiner*—Joseph S. Del Sole
(74) *Attorney, Agent, or Firm*—Oblon, Spivak, McClelland, Maier & Neustadt, P.C.

(57) ABSTRACT

The first suction port is formed between a side die and the peripheral protrusion of an upper die. A release pin insertion hole is formed at the peripheral protrusion of the upper die which forms the upper end portion of the cavity. A release pin is inserted into the release pin insertion hole. The second suction port is formed between the insertion hole and the pin. Alternatively, a plurality of vent holes having permeable sintered metal arranged are formed instead of the release pin to serve as the second suction port. The suction negative pressure of the second suction port is set higher than that of the first suction port. High negative pressure from the second suction port inhibits air from remaining on the low temperature surface portion of the upper die.

5 Claims, 5 Drawing Sheets

SUCTION CASTING METHOD AND SUCTION CASTING APPARATUS

INCORPORATION BY REFERENCE

The disclosure of Japanese Patent Application No. HEI 10-174281 filed on Jun. 22, 1998 including the specification, drawings and abstract is incorporated herein by reference in its entirety.

BACKGROUND OF THE INVENTION

1. Field of the Invention

The present invention relates to a suction casting method and a suction casting apparatus.

2. Description of the Related Art

Conventionally, there is known, for example, an automotive wheel suction casting apparatus by means of a suction casting method for sucking molten metal from the pouring gate of a die into a cavity by the application of negative pressure, which structure is shown in FIGS. 6 and 7.

The structure is as follows. A lower surface plate 102 is provided at the upper portion of a temperature holding furnace 101 and a furnace-side pouring gate 103 is provided at the surface plate 102. A die 105 provided with a die-side pouring gate 104 communicating with the furnace-side pouring gate 103, is placed on the lower surface plate 102. A chamber 106 and an upper chamber 107 surround the outer periphery of the die 105. The pressure of interiors of the chambers 106 and 107 is reduced by a suction pump 108 (i.e., negative pressure is applied to the suction pump 108). Pressure $P_1$ is applied to the interior of the cavity 112 equally through a clearance $D_1$ between a side die 109 and an upper die 110 and a clearance $D_2$ between the upper die 110 and a release pin 111, to thereby reduce the pressure of the interior of the cavity 112. Molten metal 113 within the temperature holding furnace 101 is sucked and filled into the cavity 112 through the furnace-side pouring gate 103 and the die-side pouring gate 104.

An upper surface plate 114 is fixedly attached to the lower surface plate 102. The upper chamber 107 and the upper die 110 are ascended and descended by being driven through a movable surface plate 116 by a hydraulic cylinder 115 disposed at the upper surface plate 114.

Also, there is provided suction means 118 for applying higher negative pressure than that of the interior of the cavity 112 to the abutment surface 117 between the furnace-side pouring gate 103 and the die-side pouring gate 104 using the suction pump 108, to thereby inhibit inflow of air from the abutment surface 117 into the pouring gates. The technique as described above is disclosed by, for example, Japanese Patent Publication No. 3-7465.

Meanwhile, the phenomenon of misrun occurs to a low temperature portion of the die stated above. As for the die 105, for example, short-run occurs to the surface portion of the upper die 110 lower in temperature than the side die 109 compared with the surface portion of the side die 109. Then, a space A is generated between the surface portion of the upper die 110 and a product 119 as shown in FIG. 7. As a result, the space A serves as an insulating layer to thereby cause casting defect (shrinkage) B shown in FIG. 7.

Furthermore, as stated above, even if applying high negative pressure to the abutment surface 117, the overall interior of the cavity 112 has the same pressure. Due to this, the air within the space A thus generated cannot be drawn out and removed, thereby causing casting defect B stated above as well.

SUMMARY OF THE INVENTION

It is, therefore, an object of the present invention to provide a suction casting method and a suction casting apparatus capable of inhibiting occurrence of the above space A and inhibiting occurrence of casting defect.

To achieve the above object, the present invention is a suction casting method for pouring molten metal from a pouring gate of a die into a cavity using negative pressure, wherein higher negative pressure than negative pressure of an interior of the cavity is applied to a low temperature surface portion of the die.

According to the present invention, by applying higher negative pressure than the negative pressure of the interior of the cavity to the low temperature surface portion, molten metal is well run at the surface portion to thereby inhibit air from remaining at the surface portion. Accordingly, inhibiting occurrence of the space at the surface portion and inhibiting occurrence of casting defects such as shrinkage cavity are achieved.

Moreover, the present invention in another aspect is a suction casting apparatus for pouring a molten metal into a cavity from a pouring gate of a die using negative pressure includes a first suction means for applying the negative pressure to an interior of the cavity and a second suction means for applying higher negative pressure than negative pressure of the interior of the cavity to a lower temperature surface portion of the die.

The apparatus of the present invention can achieve the method of the first invention.

Furthermore, the present invention in another aspect is a suction casting method including steps of forming a bottomed cavity out of a lower die, a side die and an upper die fitted into the side die, providing a suction port between the side die and the upper die, applying negative pressure from the suction port to an interior of the cavity and pouring molten metal into the cavity using the negative pressure includes a suction port other than the suction port is provided at a portion of the upper die at which an upper end of the cavity is formed, higher negative pressure than the negative pressure of the interior of the cavity being applied from the suction port to a side peripheral surface portion of the upper die.

According to the present invention, in case of, for example, the apparatus including an annular cavity for forming an automotive wheel using a lower die, a side die and an upper die, high negative pressure is applied to the low temperature surface portion of the upper die, thereby making it possible to inhibit occurrence of casting defect by the same function as that of the first invention.

The present invention in another aspect is a suction casting apparatus includes a bottomed cavity is formed out of a lower die, a side die and an upper die having a portion fitted into the side die and a peripheral protrusion protruding from the portion; a first suction port communicating with the cavity, is formed between the side die and the peripheral protrusion of the upper die; a release pin insertion hole communicating with the cavity is formed at the peripheral protrusion of the upper die forming an upper end portion of the cavity, a release pin inserted into the release pin insertion hole, a clearance formed between the release pin insertion hole and the release pin, the clearance serving as a second suction port; a first chamber communicating with the first suction port is provided outside the side die; a second chamber communicating with the second suction port is provided on the upper die; and a vacuum unit for applying negative pressure to an interior of the first chamber and an interior of the second chamber so that negative pressure of the interior of the second chamber is higher than negative pressure of the interior of the first chamber.

The present invention in another aspect is a suction casting apparatus includes a bottomed cavity is formed out of a lower die, a side die and an upper die having a portion fitted into the side die and a peripheral protrusion protruding laterally from the portion; a first suction port communicating with the cavity is formed between the side die and the peripheral protrusion of the upper die; a plurality of vent holes communicating with the cavity are formed at the peripheral protrusion of the upper die forming an upper end portion of the cavity, and sintered metal having permeability is arranged at a lower end of the vent holes, thereby forming a second suction port; a first chamber communicating with the first suction port is provided outside the side cavity; a second chamber communicating with the second suction port is provided on the upper die; and a vacuum unit applying negative pressure to an interior of the first chamber and an interior of the second chamber so that negative pressure of the interior of the second chamber is higher than negative pressure of the interior of the first chamber.

As can be seen from the above, if high negative pressure is applied using the release pin insertion hole, there is no need to form vent holes.

In addition, if the release pin insertion hole is used for a long time, the diameter of the hole is enlarged due to the contact of the pin with the inner wall surface of the insertion hole following the vertical movement of the pin, with the result that "spigot" (i.e., entry of molten metal into the hole) may occur. By contrast, if high negative pressure is applied using a vent hole having permeable sintered metal arranged at the lower end thereof, the diameter of the hole is not enlarged. Even if the hole diameter is enlarged, good condition can be advantageously, constantly maintained by replacing only the sintered metal.

DESCRIPTION OF THE PREFERRED EMBODIMENTS

The aspects of the present invention will now be described based on preferred embodiments shown in FIGS. 1 through 5.

FIGS. 1 through 4 show a first embodiment according to the present invention.

In the first embodiment, the present invention is applied to automotive wheel casting.

Figure 1:
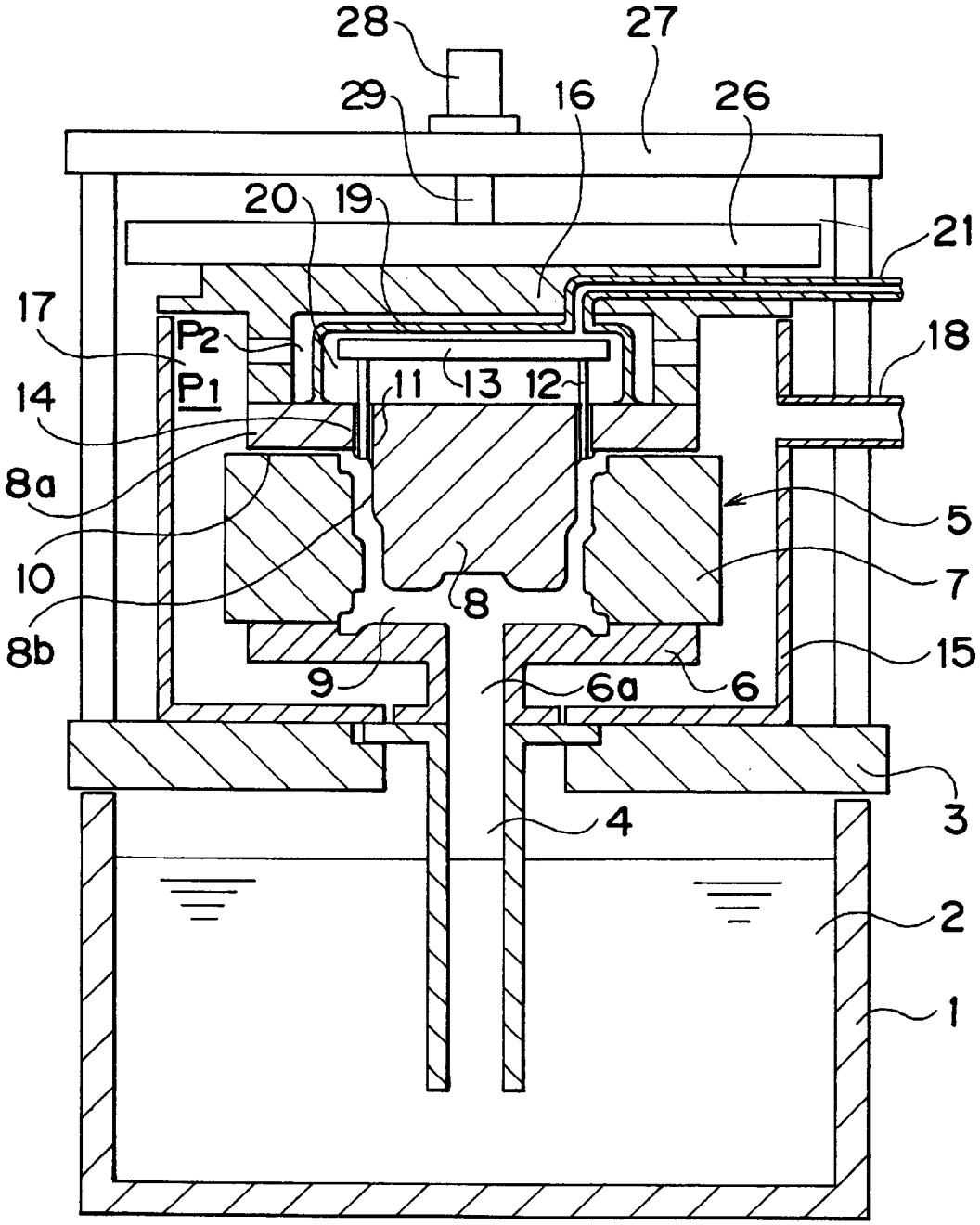
FIG. 1 is a longitudinal sectional view showing a first embodiment according to the present invention.

In FIG. 1, molten aluminum 2 is filled in a temperature holding furnace 1. A lower surface plate 3 is disposed on the upper portion of the temperature holding furnace 1 and provided with a furnace-side pouring gate 4. A die 5 consists of a lower die 6, a side die 7 and an upper die 8 fitted into the side die 7 from above. An annular bottomed cavity 9 is formed inside the die 5. The cavity 9 is formed into a shape suited for forming automotive wheels.

A die-side pouring gate **6*a* connecting to the furnace-side pouring gate 4 is provided at the lower die 6**.

Figure 3:
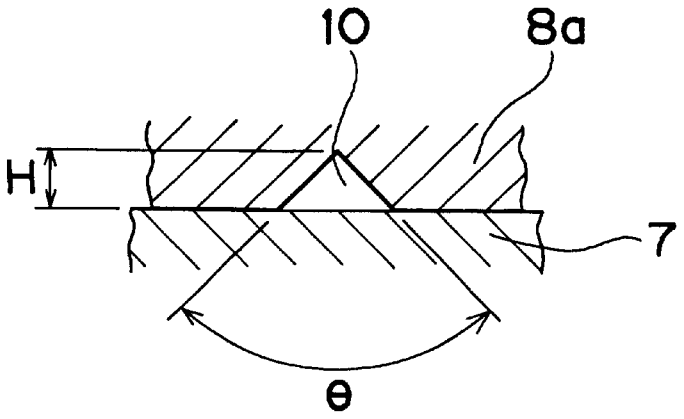
FIG. 3 is an enlarged cross-sectional view showing the first suction port in FIG. 1.

The peripheral upper surface of the lower die 6 and the lower surface of the side die 7 contact with each other at their respective flat surfaces. The upper surface of the side die 7 and the lower surface of the peripheral protrusion **8*a* of the upper mold 8 are permeably polymerized. That is, as shown in FIG. 3, a groove of a V-shaped cross section, having an opening angle θ of 60° to 90° and a depth H of 0.5 to 1 mm, is formed on the lower surface of the peripheral protrusion 8*a* of the upper die 8 in diameter direction to thereby form the first suction port 10. A plurality of first suction ports 10 are radially formed as desired. In case of normal wheel formation, several tens or more of the first suction ports 10 are formed on the circumference. Portions other than the first suction ports 10** are polymerized.

A release pin insertion hole 11 is vertically penetrated through the peripheral protrusion **8*a* of the upper die 8 positioned at the upper end portion of the cavity 9 formed by the side die 7 and the upper die 8. The inner end opening of the release pin insertion hole 11 is directed in the vicinity of the side peripheral wall 8*b* of the upper die 8. A plurality of release pin insertion holes 11** are formed, as desired, in the circumferential direction.

A release pin 12 is inserted into the release pin insertion hole 11 in an ascendable/descendable manner. The upper end of the release pin 12 is held by a member 13.

The inner diameter of the release pin insertion hole 11 and the outer diameter of the release pin 12 are designed to form a predetermined clearance therebetween. The second suction port 14 is formed out of the clearance. In the embodiment shown in FIG. 2, the outer diameter of the release pin insertion hole 11 is set at 10.1 mm, the outer diameter of the release pin 12 is set at 10 mm and the second suction port 14 is formed out of the 0.05 mm annular clearance thus formed.

The outside of the die 5 is surrounded by the first chamber 15 and the first negative pressure chamber 17 is formed outside the die 5 by the first chamber 15 and the upper chamber 16 airtight disposed on the first chamber 15. The first suction pipe 18 communicates with the first negative pressure chamber 17.

The second chamber 19 surrounding the upper portion of the member 13 from the outer peripheral portion of the release pin insertion hole 11 is airtight fixed to the upper surface of the upper die 7, thereby forming the second negative pressure chamber 20 communicating with the release pin insertion hole 11. The second suction pipe 21 communicates with the second negative pressure chamber 20.

Figure 4:
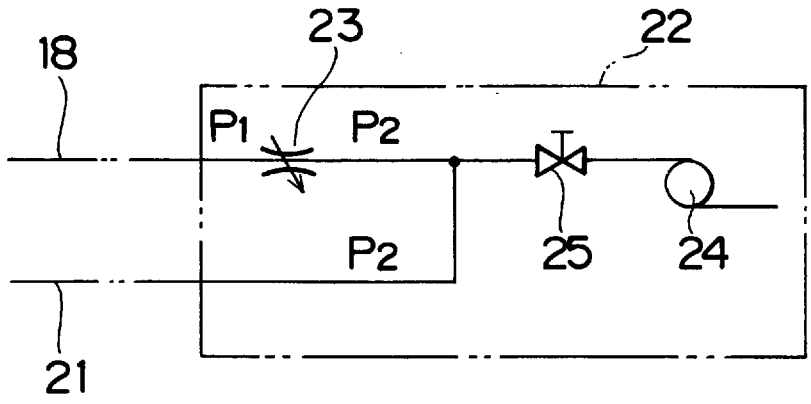
FIG. 4 is a piping drawing showing a vacuum unit shown in FIG. 1.

The first suction pipe 18 and the second suction pipe 21 are piped to the vacuum unit 22 shown in FIG. 4. That is, the first suction pipe 18 is connected to the suction pump 24 through a variable restrictor 23. The second suction pipe 21 communicates with the upstream pipe of the variable restrictor 23 and is connected to the suction pump 24. Reference symbol 25 shown in FIG. 4 denotes an opening/closing valve.

In FIG. 1, the upper die 8 is fixedly attached to the upper chamber 16, which is fixed to the movable surface plate 26. Also, an upper surface plate 27 is fixedly attached onto the lower surface plate 3. A piston rod 29 of a hydraulic cylinder 28 provided at the upper surface plate 27 communicates with the movable surface plate 26. The upper die 8 is ascended/descended by the hydraulic cylinder 28.

In the above-stated structure, the vacuum unit 22, the first negative pressure chamber 17 and the first suction port 10 constitute the first suction means as a whole, whereas and the vacuum unit 22, the second negative pressure chamber 20 and the second suction port constitute the second suction means as a whole.

Next, the function of the first embodiment will be described.

While the dies are installed as shown in FIG. 1, if the opening/closing valve 25 of the vacuum unit 22 is opened as shown in FIG. 4, and the suction pump 24 is actuated, then a suction force is applied into the cavity 9 through the variable restrictor 23 which is restricted to a predetermined value, the first suction pipe 18, the first negative pressure chamber 17 and the first suction port 10. At the same time, the suction force of the suction pump 24 is applied into the cavity 9 through the second suction pipe 21 branched from the upstream side of the variable restrictor 23, the second negative pressure chamber 20 and the second suction port 14. The molten metal 2 in the temperature holding furnace 1 is sucked from the furnace-side pouring gate 4 and the die-side pouring gate 6*a* by a suction force generated by the negative pressure applied into the cavity 9, and filled into the cavity 9 as indicated by a reference symbol 2*a* (see FIG. 2).

At this moment, the negative pressure $P_2$ of the interior of the second negative pressure chamber 20 communicating with the second suction port 21 branched from the upstream side of the variable restrictor 23, is higher than the pressure $P_1$ of the first negative pressure chamber 17. The suction force of the second suction port 14 is higher than that of the first suction port 10. In this embodiment, the suction force $P_1$ of the first suction port 10 is set at −200 mmHg and the suction force $P_2$ of the second suction port 14 is set at −400 mmHg.

At the time of sucking the molten metal 2*a,* the molten metal 2*a* at the side peripheral wall 8*b* side of the upper die 8 is solidified faster and molten metal is run differently due to the fact that the temperature of the upper mold 8 is lower than that of the side mold 7. As a result, air remains on a surface 8*b*. Nevertheless, as stated above, high negative pressure is applied from the second suction port 14, thereby strengthening the lifting force for lifting the molten metal on the surface 8*b* by the high negative force and the running difference is corrected. By doing so, molten metal running is improved and the air remaining on the surface 8*b* is drawn out, thereby inhibiting air from remaining on the surface 8*b*. Owing to this, the molten metal 2*a* is tightly attached to the overall surface 8*b,* the heat of the molten metal 2*a* is well conducted to the molds and cooled. Thus, it is possible to inhibit occurrence of casting defect (shrinkage cavity).

Figure 5:
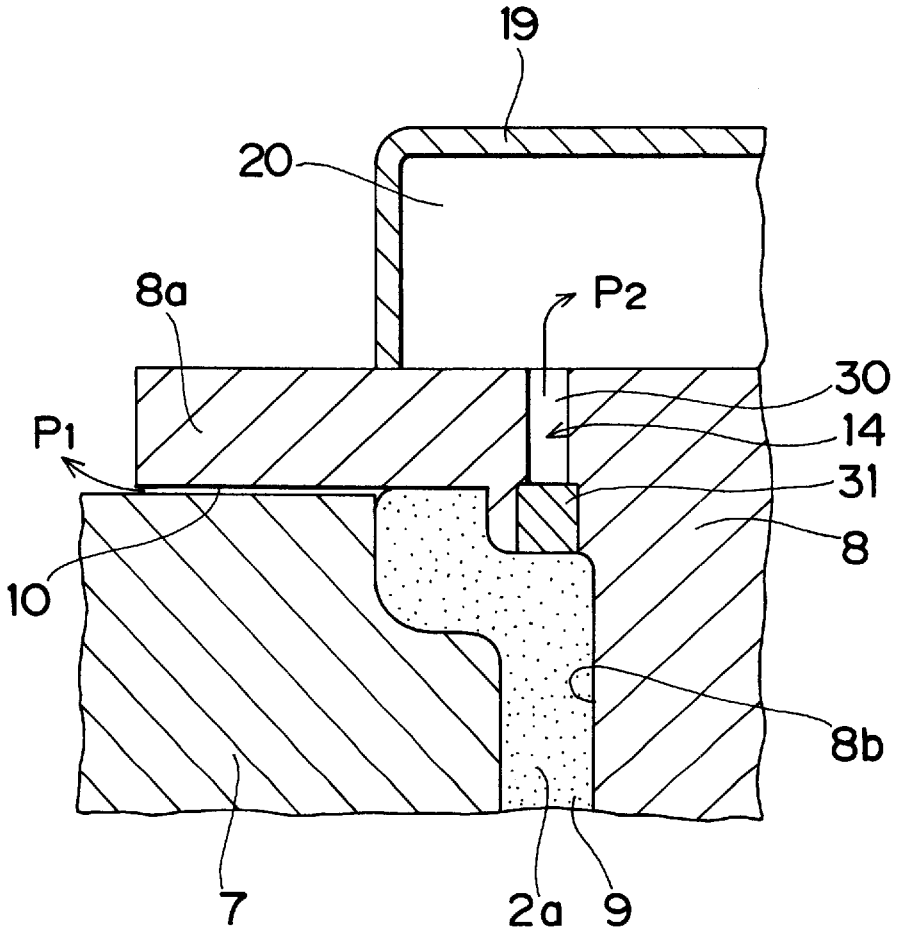
FIG. 5 is an enlarged view showing important parts of another suction port area which does not employ a release pin as shown in FIG. 1, in a second embodiment according to the present invention.
Figure 6:
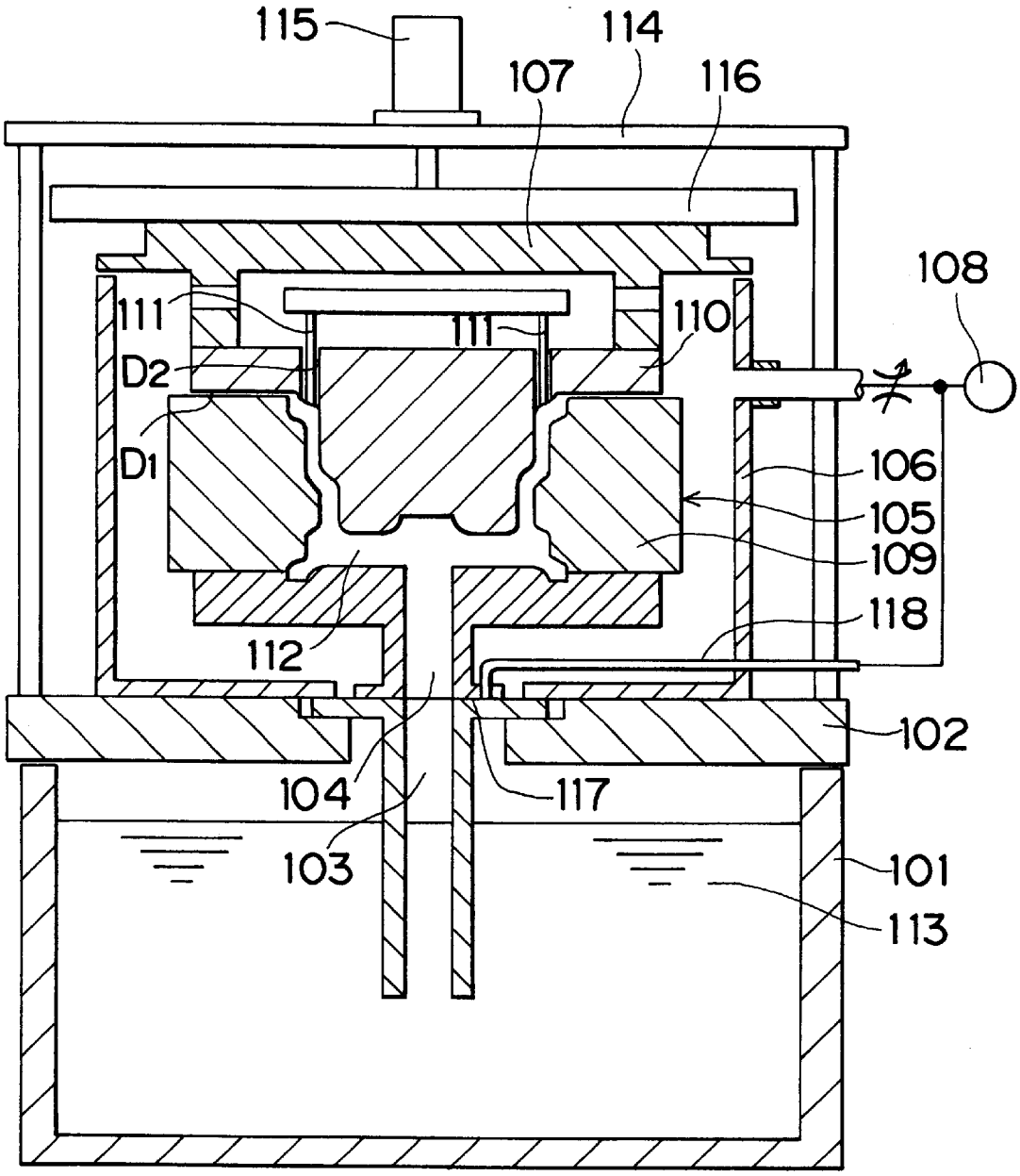
FIG. 6 PRIOR ART
FIG. 6 is a longitudinal sectional view showing a conventional suction casting apparatus.
Figure 7:
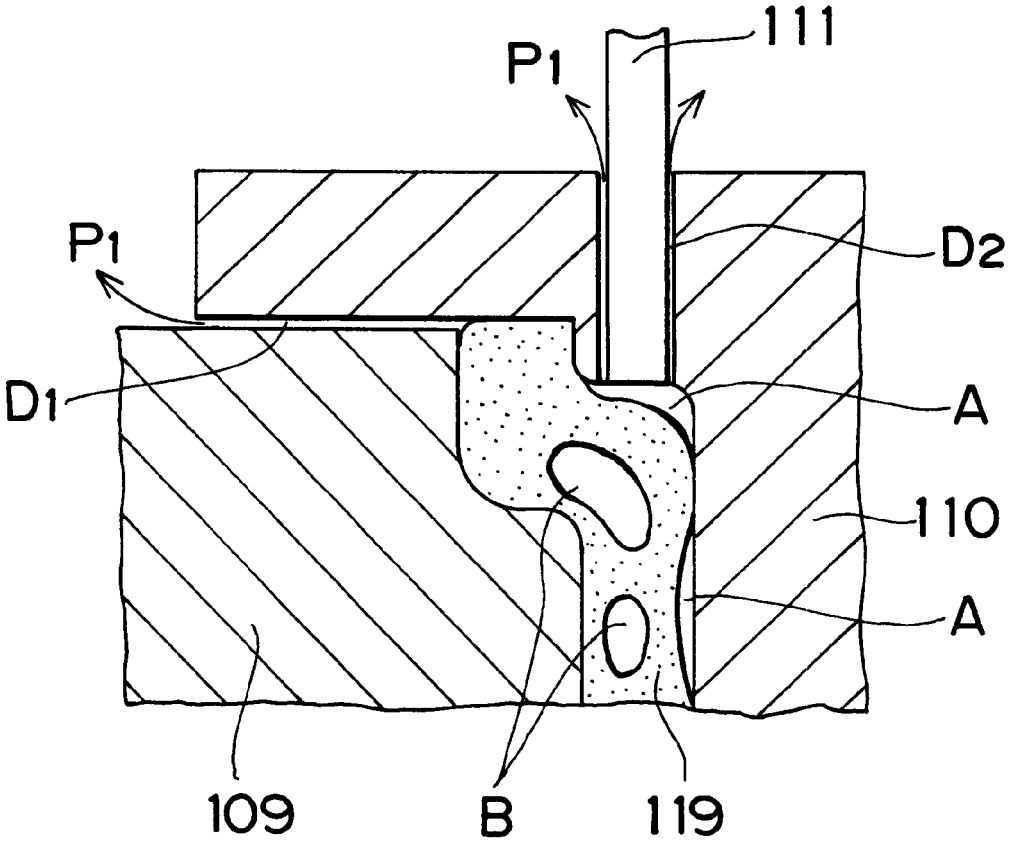
FIG. 7 PRIOR ART
FIG. 7 is an enlarged sectional view showing important parts of FIG. 6.

FIG. 5 shows a second embodiment according to the present invention.

In the second embodiment, a plurality of vent holes 30 communicating with the cavity 9, instead of the release pin 12 in the first embodiment, are formed in the peripheral protrusion of the upper die 8. Sintered metal 31 having permeability is provided at the lower end of the vent hole 30, to thereby form the second suction port 14. The remaining constitution is the same as in FIG. 1.

Figure 2:
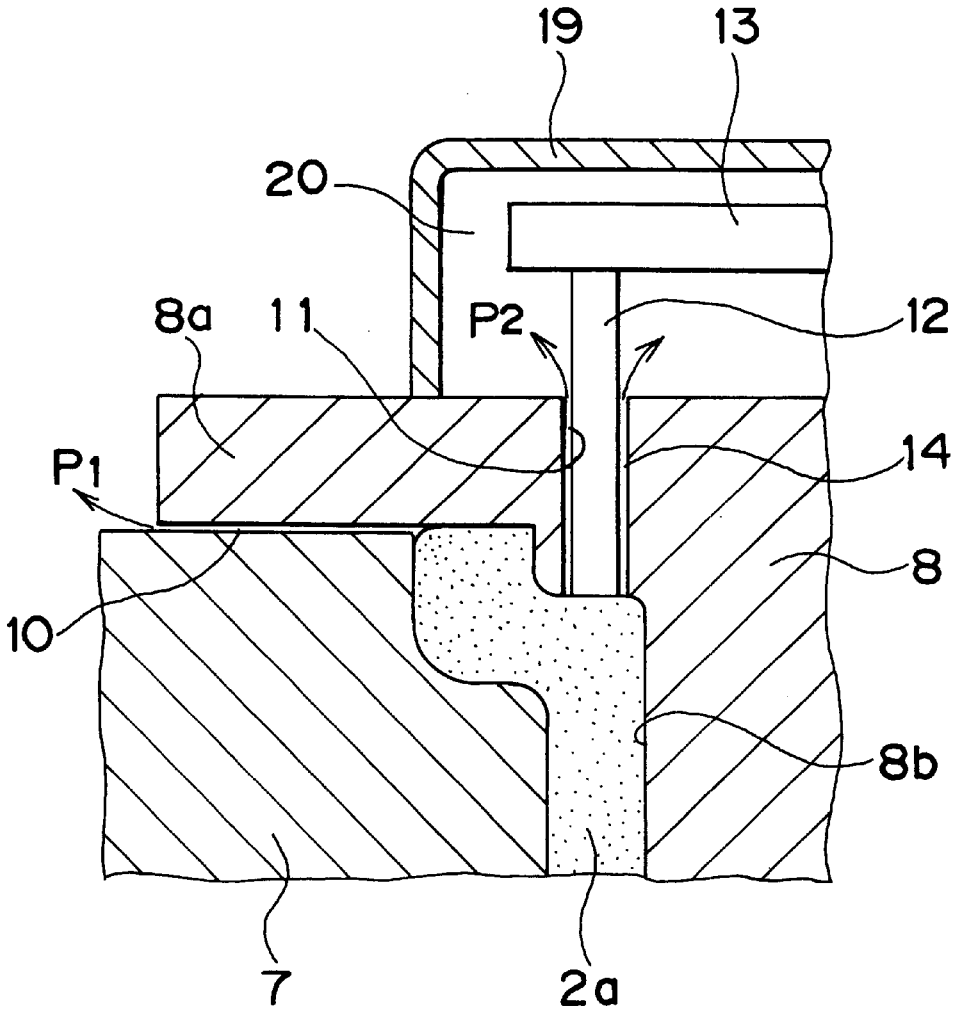
FIG. 2 is an enlarged view showing important part of a suction port area in FIG. 1.

In the second embodiment, the dies are installed in the same manner as in FIG. 1 and negative pressure is applied in the same manner as in the embodiment of FIGS. 1 and 2. Therefore, detailed description thereto will not be given herein.

As permeable sintered metal 31, sintered metal having pores provided entirely or that having a number of through holes of a diameter of 0.1 to 0.5 can be used.

In the above-stated embodiments, the present invention is applied to automotive wheel casting. The present invention should not be limited to these embodiments, but is applicable to casting of other products.

The invention claimed is:

1. A suction casting method including steps of forming a bottomed cavity out of a lower die, a side die and an upper die fitted into the side die; providing a suction port between the side die and the upper die; applying negative pressure from the suction port to an interior of the cavity and introducing molten metal into the cavity using a second suction port; providing said second suction port at a portion of the upper die at which an upper end of said cavity is formed; providing said second suction port adjacent to the first port; and applying higher negative pressure than the negative pressure of the interior cavity from said second suction port to a side peripheral surface portion of the upper die.

2. A suction casting apparatus comprising:

a bottomed cavity is formed out of a lower die, a side die and an upper die having a portion fitted into the side die and a peripheral protrusion protruding from the portion;

a first suction port communicating with said cavity, is formed between the side die and the peripheral protrusion of the upper die;

a release pin insertion hole communicating with the cavity is formed at the peripheral protrusion of said upper die forming an upper end portion of said cavity, a release pin inserted into said release pin insertion hole, a clearance formed between the release pin insertion hole and the release pin, said clearance serving as a second suction port provided adjacent to the first port;

a first chamber communicating with said first suction port is provided outside said side die;

a second chamber communicating with said second suction port is provided on said upper die; and a vacuum unit configured and connected for applying negative pressure to an interior of said first chamber and an interior of said second chamber so that negative pressure of the interior of said second chamber is higher than negative pressure of the interior of said first chamber.

3. A suction casting apparatus comprising:

a bottomed cavity is formed out of a lower die, a side die and an upper die having a portion fitted into the side die and a peripheral protrusion protruding laterally from the portion;

a first suction port communicating with said cavity is formed between the side die and the peripheral protrusion of the upper die;

a plurality of vent holes communicating with the cavity are formed at the peripheral protrusion of said upper die forming an upper end portion of said cavity, and sintered metal having permeability is arranged at a lower end of the vent holes, thereby forming a second suction port provided adjacent to the first port;

a first chamber communicating with said first suction port is provided outside said side cavity;

a second chamber communicating with said second suction port is provided on said upper die; and a vacuum unit configured and connected for applying negative pressure to an interior of said first chamber and an interior of said second chamber so that negative pressure of the interior of the second chamber is higher than negative pressure of the interior of the first chamber.

4. A suction casting apparatus comprising:

a bottomed cavity is formed out of a lower die, a side die and an upper die having a portion fitted into the side die and a peripheral protrusion protruding from the portion;

a first suction port communicating with said cavity, is formed between the side die and the peripheral protrusion of the upper die;

a release pin insertion hole communicating with the cavity is formed at the peripheral protrusion of said upper die forming an upper end portion of said cavity, a release pin inserted into said release pin insertion hole, a clearance formed between the release pin insertion hole and the release pin, said clearance serving as a second suction port provided adjacent to the first port;

a first chamber communicating with said first suction port is provided outside said side die;

a second chamber communicating with said second suction port is provided on said upper die; and vacuum means for applying negative pressure to an interior of said first chamber and an interior of said second chamber so that negative pressure of the interior of said second chamber is higher than negative pressure of the interior of said first chamber.

5. A suction casting apparatus comprising:

a bottomed cavity is formed out of a lower die, a side die and an upper die having a portion fitted into the side die and a peripheral protrusion protruding laterally from the portion;

a first suction port communicating with said cavity is formed between the side die and the peripheral protrusion of the upper die;

a plurality of vent holes communicating with the cavity are formed at the peripheral protrusion of said upper die forming an upper end portion of said cavity, and sintered metal having permeability is arranged at a lower end of the vent holes, thereby forming a second suction port provided adjacent to the first port;

a first chamber communicating with said first suction port is provided outside said side cavity;

a second chamber communicating with said second suction port is provided on said upper die; and vacuum means for applying negative pressure to an interior of said first chamber and an interior of said second chamber so that negative pressure of the interior of the second chamber is higher than negative pressure of the interior of the first chamber.

* * * * *

UNITED STATES PATENT AND TRADEMARK OFFICE

CERTIFICATE OF CORRECTION

PATENT NO. : 6,311,758 B1 
DATED : November 6, 2001
INVENTOR(S) : Sakabe et al.

It is certified that error appears in the above-identified patent and that said Letters Patent is hereby corrected as shown below:

Title page,
Item [75], the Inventors' information should read:
-- [75] Inventors: Haruyuki Sakabe; Tomokazu Sawada, both of Hazu-gun; Ryuuichi Masuda; Hiroyuki Urushidani, both of Okazaki-shi, all of (JP) --

Signed and Sealed this

Twelfth Day of March, 2002

*Attest:*

*Attesting Officer*

JAMES E. ROGAN
*Director of the United States Patent and Trademark Office*